United States Patent [19]

McGough

[11] Patent Number: 4,852,373

[45] Date of Patent: Aug. 1, 1989

[54] LOCK PROTECTOR ASSEMBLY

[75] Inventor: Gerald B. McGough, Huntsville, Ala.

[73] Assignee: Palco Telecom Inc., Nashville, Tenn.

[21] Appl. No.: 305,709

[22] Filed: Feb. 3, 1989

[51] Int. Cl.[4] ..... E05B 63/00

[52] U.S. Cl. ..... 70/417; 70/418

[58] Field of Search ..... 70/417, 418, 451, 370

[56] References Cited

U.S. PATENT DOCUMENTS 1,687,388 10/1928 Rigo ..... 70/418

4,212,176 7/1980 Hegedos ..... 70/417

FOREIGN PATENT DOCUMENTS 2545140 4/1977 Fed. Rep. of Germany ..... 70/417

732594 6/1955 United Kingdom ..... 70/418

*Primary Examiner*—Robert L. Wolfe

*Attorney, Agent, or Firm*—Robert J. Black

[57] ABSTRACT

A lock protector assembly consisting of a cast protector element, a back up plate and a clamping plate all adapted to fit in the interior of a telephone paystation to substantially improve the resistance of the upper housing of a telephone paystation, with respect to illegal strong arm attack and entry possibilities.

9 Claims, 1 Drawing Sheet

LOCK PROTECTOR ASSEMBLY

BACKGROUND OF THE INVENTION

1. Field of the Invention

The present invention pertains to telephone paystations and more particularly to a lock protector assembly for use with the lock intended in the upper housing of a telephone paystation.

2. Background Art

A substantial portion of both the deregulated and regulated paystation industry have utilized in the instruments they manufacture housings of the type that have been manufactured for many years by such organizations as AT&T, GTE and Palco Telecom. It has been generally found that such housings include adequate security measures. However, in some locations telephone companies or other users have found that the security of the upper housings of telephone units have become a problem. Companies which have high investments in upper housings and "smart" circuit cards included in the housings are being victimized by break-ins. Strong desire exists on the part of such companies or other users to protect their investment in the telephone instruments as well as the coinage that may have been deposited in the telephone instruments and of course the included technology in the telephone instrument.

The particular type of break-in usually of concern is by entry through the sheet metal skin of the upper housing by filing, drilling, or chiseling and by use of further destructive techniques to break or unlock the upper housing lock. As noted, sometimes the target is the electronics and sometimes it is the pilferage of the actual coinage that has been deposited in the vault of the telephone paystation. This may be accessed through an opening in the top of the vault by way of the upper housing.

At least one suggestion to overcome the problem was the use of a heavy metal plate welded to the exterior of the upper housing coupled with another heavy plate assembled to the inside of the housing. While the resultant change in the telephone presents a rather imposing appearance, such items do not actually offer protection commensurate with the additional cost. This arrangement includes an extra layer of metal to go through. Once this is accomplished there is still the open space around the lock assembly. Also, the paystation lock, lock cam and lock bolt do not receive any extra internal support. The suggested arrangement was also not field installable since the exterior plate is welded to the upper housing. This arrangement also requires the addition of a new faceplate and the appearance thus is altered so that it tips off any individual that the particular paystation does include indeed the additional extra protection. Thus the design and the net result is of a generally unacceptable standard which does not meed "user friendly" appearance.

SUMMARY OF THE INVENTION

The present invention consists of a lock protector assembly intended for use with the lock that is mounted in the telephone paystation housing. The lock is of a cylinder type that includes in addition to the cylinder a cam and a bolt all of which are mounted internally within the paystation housing. The protector assembly includes a protector which is a stainless steel casting including arcuate shaped indentations which are adapted to receive the lock bolt and the lock cam when the lock is operated to the lock position. Also included in the protector assembly is a back up plate which abuts the cylinder lock and also includes indentations which allow it to partially surround the cylinder and the lock bolt. Over the lock, including its cylinder, cam and bolt, is a clamping plate which is also positioned over the protector casting and the back up plate and provides a complete cover over the entire assembly. Thus with the protector, back up plate and clamping plate in combination with the housing itself the lock and its associated parts are all surrounded by additional protected metal assemblies which act to prevent the type of typical intrusion and destructive technique usually found when attempts are made to break into paystation housings.

DESCRIPTION OF THE PREFERRED EMBODIMENT

Figure 1:
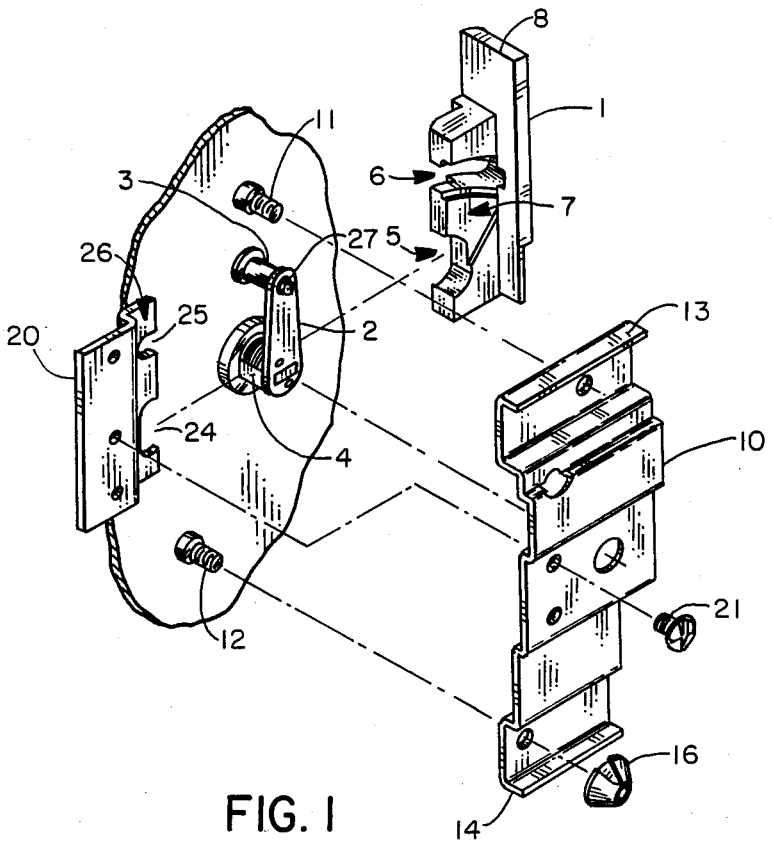
FIG. 1 is an exploded partial perspective view of the interior of a telephone paystation upper housing showing the paystation lock and the lock protector assembly in accordance with the present invention.
Figure 2:
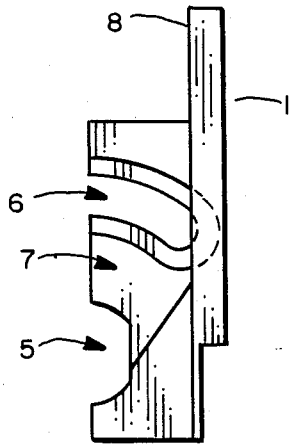
FIG. 2 is a front view of a cast protector in accordance with the present invention.
Figure 3:
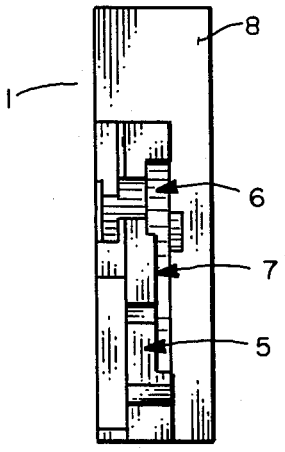
FIG. 3 is a side view of a cast protector in accordance with the present invention.

Referring now to FIGS. 1, 2, and 3 of the present invention, the first and most important portion of the present invention is the cast stainless steel protector 1 which fits into the front corner of the upper housing of a telephone paystation in front of and surrounding a lock mechanism consisting of lock cylinder 4, lock bolt 3 and lock cam 2. The protector is assembled to the inside of the upper housing by rotating the lock cam 2 and bolt 3 to the locked position and the sliding the protector 1 underneath the lock cam 2 and the lock cylinder 4 and lock bolt 3 into the provided slots 5, 6 and 7. The lock bolt slot 6 is extended and a portion of a groove for the lock cam 7 is provided to allow lock rotation to the unlocked position. The lock bolt slot 6 and portion of the cam groove 7 are as tight fitting as possible. If the corner of the upper housing were to be attached to gain entry, the stainless steel metal of the protector 1 would severely inhibit any penetration. Should penetration be made, the lock bolt slot 6 and a portion of the cam groove 7 are likely to be distorted and/or filled with metal chips thus making any movement of lock bolt 3 and the lock cam 2 to the unlocked position to be extremely difficult if not impossible.

In the protector 1, the slot for lock cylinder 5 is one-half of a double "D" configuration. This particular configuration provides substantial additional strength to the lock cylinder 4 from being rotated with a pipe-wrench from the exterior of the upper housing in an attempt to gain entry.

The second portion of the lock protector assembly of the present invention is the protector clamping plate 10 whose primary function is to hold the protector casting 1 in place. The protector clamping plate 10 mounts to existing locking bar mounting studs 11 and 12 on the inside of the paystation upper housing as may be seen by reference in FIG. 1.

The protector clamping plate 10 mounts parallel to the side wall of the upper housing. It holds the protector 1 in place vertically by having a formed channel into which it fits snugly as may be seen by reference to FIG. 1 and particularly to clamping plate 10. Left to right clamping is provided by capturing the protector 1 between the clamping plate and the side of the housing. Front to back movement of the protector 1 is controlled by capturing the flange 8 of the protector 1 between the interior face of the upper housing and the clamping plate 10.

Another function of clamping plate 10 is to form an outside protective wall for the lock mechanism. This feature is included in the event that the upper housing can be broken into through the keypad area. The clamping plate 10 also acts as a wall to form the outside portion of the groove 7 in which the lock cam 2 rotates.

When the paystation upper housing is assembled to the lower housing in the usual manner, the clamping plate 10 spans between the flange of the protector 1, resting against the face of the upper housing to the strike plate of the rear housing thereby gaining additional strength and support from the rear housing in any attempted break-in. Clamping plate 10 mounts to the mounting studs 11 and 12. It is counterbored to gain the full diameter of the studs (approximately 0.375" in diameter) rather than the threaded diameter strength (0.250" thread). Also, it should be noted that the ends of the plate have turned up flanges 13 and 14 which act to protect mounting nut 15 (not shown) and nut 16. Should the nuts be removed, of course, the entire system would then break down.

The remaining major portion of the invention is the inclusion of back up plate 20 which is mounted using three special screws 21, 22 and 23 (22 and 23 are not shown) which are utilized in attaching the back up plate 20 to the clamping plate 10. The back up plate provides additional support to the lock cylinder, or the lock bolt 3 and lock cam 2 and also additional strength to clamping plate 10. The back up plate 20 completes the surrounding and encasement of the locking mechanism in accordance with the terms of the present invention.

The back up plate 20 contains slots 24 and 25 which surround lock cylinder 4 and lock bolt 3, respectively. These slots line up with their mating slots 5 and 6 in the protector to form a stock or yoke arrangement. In addition, the back up plate 20 has a formed portion 26 which in conjunction with the protector and clamping plate form a groove for the lock cam and, if used, a double headed lock bolt which will be described below.

The optional special lock bolt 27 provides additional security. This special bolt has a second head on the end secured to the lock cam. Should the side wall of the upper housing be broken through and the lock bolt is pried towards or grasped and pulled to the outside, the second head will absorb the force by engaging the slot 25 in the back up plate 20. This action will relieve the force from the lock bolt 3 mounting screw and prevent breakage of the screw and subsequent removal of lock bolt 3.

An additional portion of the present invention is the inclusion of special nuts, such as 16 and 17 (17 not shown), which are utilized in mounting the clamping plate to studs 12 and 11, respectively. They are turned onto the existing mounting studs 11 and 12 and replace the standard mounting nuts and washers usually utilized. They are provided as part of the present invention as an option to provide additional security. The nuts 16 and 17 have slots on beveled sides for rotation in the tightening direction only by using a screwdriver in a pushing fashion. Use of the screwdriver and the slots included are designed similar to a pawl and ratchet wheel arrangement. The nuts are further beveled to provide protection from the use of chisels.

To further assist in the security of the present invention are tighten only screws, such as 21, and 22 and 23 (not shown), which are utilized for mounting the protector back up plate 20 to the clamping plate 10. Naturally standard screws may be utilized but would not provide the same degree of security. As shown, the special screws go through holes in the clamping plate 10 and tap into back up plate 20.

As can be seen from the foregoing, the thick hard cast metal protector interspaces, envelopes and supports the upper housing lock mechanism. The protector with its inclusion of a slot and a groove for upper housing lock movement contains one-half of a double "D" for supporting the lock cylinder. Due to the mass of its hard metal, it is capable of resisting brutal attacks upon the locking mechanism.

Clamping plate 10 securely holds the protector 1 in place mounting it to the existing mounting studs 11 and 12. Noted previously, clamping plate 10 is further supported by the lower housing when the upper housing is assembled. The mounting stud areas are counterbored to obtain full strength of the mounting studs. Turned up lips 13 and 14 at either end further protect the mounting nuts from any chisel attack.

The back up plate 20 includes a slot 25 for support of lock bolt 3 against breakage. The slot also protects against pulling out of the lock bolt when the special double headed lock bolt 27 is used. In addition, by virtue of its slot 24 which acts to provide the second one-half of the double "D" for supporting the lock cylinder additional protection is provided and its formation as noted further assists in completing a groove for the lock cam 2.

The optional lock bolt with an additional head which when engaged with the slot in the back up plate prevents breaking or pulling out of the lock bolt.

The use of optional nuts and screws further increases the security of the present protector assembly while the combination of the protector 1, the back up plate 20 and the clamping plate 10 provide for a close fitting slot for the lock bolt 3 and a close fitting groove for the lock cam 2 so that if attempted entry is made distortion and/or metal chips will cause the lock mechanism to become inoperable further providing the necessary security to the telephone paystation to which the protector assembly has been installed.

What is claimed is:

1. A lock protector assembly for use with a lock mounted in a telephone paystation housing, said lock of the type including a cylinder, a cam and a bolt all mounted within the interior of said paystation housing, said lock protector assembly comprising:

a protector positioned along a first side of said lock, adapted to receive said bolt and said cam, when said lock is operated to a locked position;

a back up plate positioned along a second side of said lock;

a clamping plate secured to said paystation interior and further fastened to said back up plate, and positioned over said protector;

whereby said protector, said back up plate and said clamping plate in combination with said paystation housing provide a protective enclosure for said lock.

2. A lock protector assembly as claimed in claim 1 wherein:

said protector includes a first arcuate groove adapted to receive said bolt and a second arcuate groove adapted to received said cam and an indention adapted to receive said cylinder.

3. A lock protector assembly as claimed in claim 1 wherein:

said protector comprises a stainless steel casting.

4. A lock protector assembly as claimed in claim 1 wherein:

said clamping plate comprises a multiplaner structure, including an orifice therein aligned with said lock cylinder.

5. A lock protector assembly as claimed in claim 4 wherein:

said clamping plate is of metallic construction.

6. A lock protector assembly as claimed in claim 1 wherein:

said back up plate is of biplanar construction and includes a first slot adapted to support said bolt and a second slot adapted to partially encircle said lock cylinder.

7. A lock protector assembly as claimed in claim 6 wherein:

said back up plate is of metallic construction.

8. A lock protector assembly as claimed in claim 1 wherein:

there is further included a plurality of special screws adapted to fasten said clamping plate to said back up plate.

9. A lock protector assembly as claimed in claim 1 wherein:

there is further included a plurality of special threaded studs fastened to the interior of said paystation housing and adapted to receive said clamping plate in a position covering the rear of said lock;

and a plurality of special nuts each adapted to assist in the securing of said clamping plate to said studs mounted on the interior of said paystation telephone housing.

* * * * *